United States Patent [19]

Brown

[11] Patent Number: 4,883,276

[45] Date of Patent: Nov. 28, 1989

[54] GOLF AID

[76] Inventor: Len T. Brown, 7 Ridge Drive, Heuwelkruin, KNYSNA, Cape Province, South Africa

[21] Appl. No.: 227,237

[22] Filed: Aug. 2, 1988

[30] Foreign Application Priority Data

Aug. 4, 1987 [ZA] South Africa ..... 87/5754

[51] Int. Cl.[4] ..... A63B 69/36

[52] U.S. Cl. ..... 273/183 B; 273/191 R

[58] Field of Search ..... 273/188 R, 183 B, 183 R, 273/183 D, 186 A, 186 R, 186 C, 191 R, 191 A, 191 B, 192

[56] References Cited

U.S. PATENT DOCUMENTS 4,688,800 8/1987 Lopex ..... 273/183 B

*Primary Examiner*—George J. Marlo

*Attorney, Agent, or Firm*—St. Onge Steward Johnston & Reens

[57] ABSTRACT

A golf aid which comprises a harness and a structure to which the harness is secured. The harness is intended to pass under the user's arm pits and around his back so that the structure is located in a hanging position overlying the user's chest. The structure is of vee-shape, is triangular or T-shaped thereby to provide an offset apex which is below the level at which the harness is attached to the structure. The golf aid assists the golfer in positioning his body correctly whilst he is swinging the golf club. During correct movement of the body the apex points at the user's hands where they grip the club.

5 Claims, 2 Drawing Sheets

GOLF AID

THIS INVENTION relates to golf aids.

BACKGROUND OF THE INVENTION

Every golfer is aware that distance can be improved and the direction in which the ball travels can be controlled if he executes not only the downswing but also the backswing correctly. Many golf aids have been proposed which a golfer uses during practice and which, by one means or another, impose upon him arm and body movements which are accurate. In U.S. Pat. No. 4,422,643, there is described a device which includes a guide bar which extends diagonally across the golfer's chest. With this device on him a golfer must swing correctly otherwise there is interference between his arms, the club, and the device. In U.S. Pat. No. 4,688,800, there is shown a device which the golfer wears around his waist and which protrudes out from his waist in such a manner that, if the swing is improper, the protruding part interferes. In U.S. Pat. No. 4,662,620, there is shown a device which includes a practice golf club which is attached to the golfer by an elastic harness. As the golfer practices his swing, the tensions in the various parts of the harness vary and this imparts 'feel' which enables the golfer to detect if he is swinging incorrectly.

OBJECTS OF THE INVENTION

The main object of the invention is to provide a simple golf aid which assists a golfer in correcting faults in his backswing, downswing, and follow through.

A further object of the invention is to provide a golf aid which is of use in assisting a golfer perfect not only his drive but also his putting and chipping techniques.

BRIEF DESCRIPTION OF THE INVENTION

According to the present invention there is provided a golf aid which comprises a harness and a structure to the upper part of which said harness is connected, said harness enabling said structure to be worn over the chest region, the structure hanging downwardly from where the harness is connected to it to a downwardly pointing apex.

The structure can take a number of forms. In its preferred form, the structure is constituted by a triangular plate which has said apex at the lower end thereof. In order form, the structure is T-shaped, and in a still further form the structure is vee-shaped.

It is preferred that the structure be asymmetrical so that the apex is offset to one side of a vertical centre line of the structure.

BRIEF DESCRIPTION OF THE DRAWINGS

For a better understanding of the present invention, and to show how the same may be carried into effect, reference will now be made, by way of example, to the accompanying drawings, in which.

Figure 1:
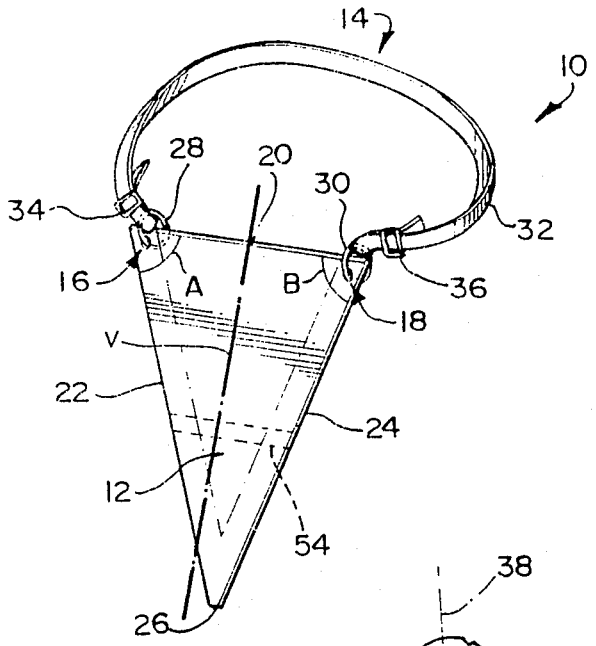
FIG. 1 is a three-dimensional view of a golf aid in accordance with the present invention.

Referring firstly to FIG. 1, reference numeral 10 generally indicates a golf aid in accordance with the present invention. The golf aid 10 includes a structure 12 and a harness 14. Two horizontally spaced holes 16, 18 are provided adjacent the points at which the upper horizontal edge 20 of the structure 12 meets two side edges 22 and 24 which extend downwardly and converge at an apex 26. Rings 28, 30 are passed through the holes 16, 18, and a strap 32 which includes length-adjusting buckles 34, 36 is attached to the rings 28, 30. The angle designated A between the edges 20, 22 is smaller than the angle B between the edges 20, 24. Thus, when the edge 20 is horizontal, the edge 24 is closer to vertical than the edge 22, and the apex is offset horizontally from a vertical centre line V of the structure. The approximate dimensions of the preferred constructional form are:

| | |
|---|---|
| angle A | 60 degrees |
| angle B | 80 degrees |
| edge 20 | eighteen cm |
| edge 22 | thirty two cm, and |
| edge 24 | twenty nine cm. |

The structure 12 can be a plate of metal or synthetic plastics material.

Figure 2:
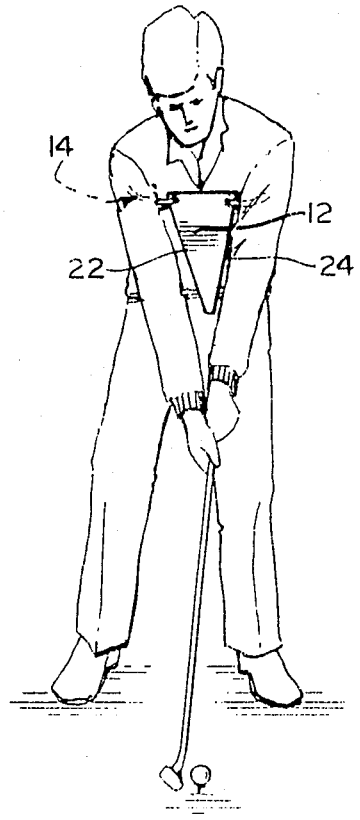
FIG. 2 is a front view of a golfer wearing the golf aid and standing at address.
Figure 3:
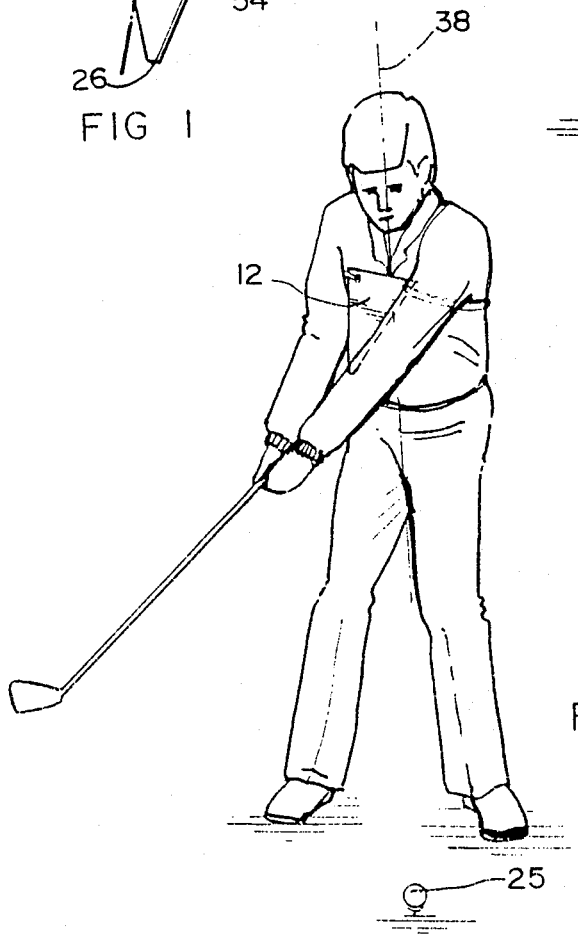
FIGS. 3 and 4 show a golfer at two different positions during a back swing which includes a pivot or shoulder turn.

The golf aid is worn during practice. This is shown in FIG. 2. The golfer fastens the strap 32 around him, just below the level of his arm pits, so that the structure 12 hangs down over this chest. Because the golfer's hands grip the club at different vertical positions, his arms are not at the same angle. The asymmetrical shape of the structure 12 enables it to fit snugly in the space between the golfer's arms. Because the golfer is leaning forward slightly, the apex 26 points directly at the location at which he is gripping the club.

Striking a golf ball properly involves a combined movement of the arms and also a pivoting movement of the shoulders about an axis 38 which is substantially coincident with the golfer's spine. During a correct backswing, the golfer should pivot the entire upper part of his body in the direction which he is moving the club. If, during a practise backswing, the golfer glances down at the golf aid, he will readily be able to note whether the apex 26 is generally aligned with the location at which he is gripping the club. If it is, then he knows that he is pivoting his body correctly.

During the downswing and follow through, the torso should also pivot about the axis 38. Thus, for the major part of the downswing and follow through the apex 26 will follow the location at which the club is being gripped.

If the golfer does not pivot his torso corectly then, when he looks down, he will find that the apex 26 and the location at which he is gripping the club are no longer in alignment. In the extreme case of no torso movement, the structure 12 will not move at all and the misalignment between the apex 26 and the location at which the club is gripped will be readily apparent to the golfer. As he improves his body motion so the alignment between the apex and the club gripping location will improve.

Figure 6:
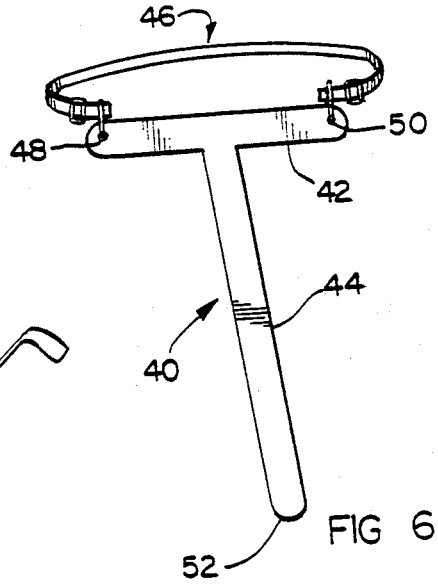
FIG. 6 is a three-dimensional view of a further golf aid in accordance with the present invention.
Figure 4:
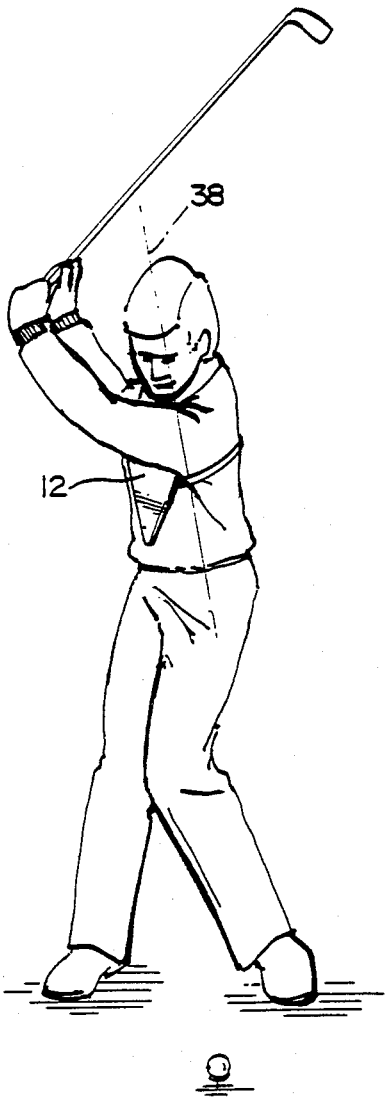
Figure 5:
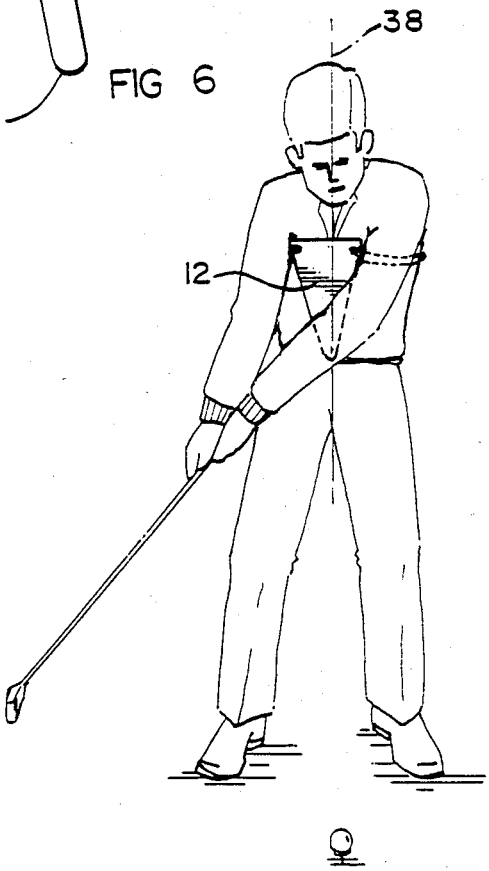
FIG. 5 shows a golfer during an incorrect back swing, ie a back swing which does not include a pivot or shoulder turn.

The gold aid shown in FIG. 6 includes a T-shaped structure, generally designated 40, which includes a horizontal cross-bar 42 and a leg 44, the cross-bar 42 and the leg 44 being skew with respect to one another. A harness 46 is attached to the structure 40, the mounting points 48 and 50 for the harness 46 being at the ends of the cross-bar 42. The lower end 52 of the leg 44 forms an apex which is equivalent to the apex 26 shown in FIG. 1 and is horizontally offset from a vertical centre line of the structure.

The golf aid of FIG. 6 is used in the same manner as the golf aid of FIG. 1.

The golf aid of FIG. 1 has an advantage over the golf aid of FIG. 6 in that its structure provides a larger surface area on which advertising material and instructions can be printed. it is possible, however, for a V-shaped central section of the structure 12 to be omitted. The area which can be omitted has been bounded in FIG. 1 by a chain-dotted line. Only the portion of the structure which lies outside that line is restrained, and the resultant structure is thus V-shaped with the mounting points for the harness 14 at the upper ends of the two diverging limbs of the structure. A V-shaped structure is used in the same way as the structure described above.

Reference numeral 54 in FIG. 1 indicates a zone which is demarcated and which extends across the structure 12 from edge 22 to edge 24. When the edge 20 is horizontal the zone 54 slopes downwardly at a shallow angle from edge 24 to edge 22. This zone can be used to assist the golfer in getting the feel of a proper backswing to a forty five degree angle. He places the shaft of his club along the demarcated zone and holds the structure 12 either horizontally or at a slight downward slope so that it points away from his body. The club is almost horizontal at this stage. He then pivots his body, his hands, the club and the structure 12 so that the head end of the club moves upwardly and the club shaft takes up a forty five degree angle.

The hand movement necessary to cause the shaft to do this results in the torso pivoting in the proper manner.

I claim:

1. A golf aid which comprises a harness and a structure to the upper part of which said harness is connected, said harness being in the form of a horizontally extending loop which enables said structure to be worn over the chest region with the harness extending around the user's back, the harness being secured to said structure at two horizontally spaced locations, the structure lying in a substantially vertical plane and hanging downwardly from where the harness is connected to it to a downwardly pointing apex which is offset horizontally from a vertical centre line which is equi-distant horizontally from said two locations at which the harness is attached to the structure.

2. A gold aid as claimed in claim 1, wherein said structure comprises an element including two limbs which define a vee, said apex being at the point of the vee and one of said limbs being longer than the other so that said apex is offset horizontally with respect to said vertical centre line of the structure.

3. A golf aid as claimed in claim 1, wherein said structure is T-shaped, a leg of the T extending downwardly from a cross-bar of the T to said apex, said cross-bar and the leg of the T being skew with respect to one another so that the apex is offset horizontally with respect to said vertical centre line of the structure.

4. A golf aid as claimed in claim 1, wherein said structure is in the form of a plate which is triangular in shape and has a straight, horizontal upper edge, said harness being secured to the structure adjacent upper horizontal edge of the structure and the structure having two side edges which extend downwardly and converge at said apex, the angle between said horizontal edge and one of said side edges differing from the angle between said horizontal edge and the other side edge, and one side edge being longer than the other whereby the apex is offset horizontally with respect to said vertical centre line of the structure.

5. A golf aid as claimed in claim 1, wherein said harness comprises a strap intended to extend under the armpits of the wearer and around the wearer's back, means for adjusting the length of the strap, horizontally spaced holes in the upper part of said structure and rings passed through said holes, said strap being attached to said rings.

* * * * *